US005927966A

United States Patent [19]

Herrin

[11] Patent Number: 5,927,966

[45] Date of Patent: Jul. 27, 1999

[54] RECEPTACLE FOR COLLECTING WAX DRIPPING FROM A CANDLE AND METHOD OF USE

[76] Inventor: Jean L. Herrin, 9771 Kate Ct., Terre Haute, Ind. 47802

[21] Appl. No.: 09/080,681

[22] Filed: May 18, 1998

[51] Int. Cl.[6] ..... F23D 3/16

[52] U.S. Cl. ..... 431/292

[58] Field of Search ..... 431/292, 293, 431/294; 141/337

[56] References Cited

U.S. PATENT DOCUMENTS 1,195,657 8/1916 Chersky ..... 431/294

4,544,351 10/1985 Marsicano ..... 431/292

4,896,707 1/1990 Cowles ..... 141/337

*Primary Examiner*—Carroll B. Dority

*Attorney, Agent, or Firm*—Ted Masters

[57] ABSTRACT

A receptacle (20) for collecting wax drippings (504) from a candle (500) includes an annular-shaped sheet (22) which is generally in the form of a truncated conical surface having a first side (24) and an opposite second side (26). Sheet (22) has an opening (34) which defines two ends (36) and (38). An adhesive (40) is applied to first side (24) of sheet (22). The first (24) and second (26) sides of sheet (22) are overlapped and pressed together to form an inverted truncated conical shell or collar which is placed around the base of the candle (500) to collect the wax drippings (504).

16 Claims, 9 Drawing Sheets

504
500
503
20
8
8
502

RECEPTACLE FOR COLLECTING WAX DRIPPING FROM A CANDLE AND METHOD OF USE

TECHNICAL FIELD

The present invention pertains to candles, and in particular to a receptacle which collects the hot wax which drips from a burning candle.

BACKGROUND ART

Candles and candle holders are well know in the art. For example, U.S. Pat. No. 5,292,245 shows a plastic hand held candle holder. The candle holder has an integral body made from polypropylene which includes a tubular handle having a closed end, and open end and a cup extending upwardly from the open end of the handle. A plurality of elongate ridges extend longitudinally along the interior of the handle. These ridges hold the stem of a candle in a stationary position in the holder. U.S. Pat. No. 5,078,945 illustrates a combined candle holder and mold apparatus which includes a free-standing container having an open upper end and within which candle supporting structure is provided on which a burning candle is adapted to be supported so as to extend upwardly through and beyond the open container end. U.S. Pat. No. 4,544,351 defines a candle holder formed of paper, plastic or the like which can be inserted into a hollow article such as a glass for the purpose of providing a support for a candle in the case of emergency or when a conventional candle holder is not available. The candle holder comprises radially inwardly extending slits at the center portion thereof which define generally triangular inner tabs for frictionally engaging a candle. U.S. Pat. No. 3,330,132 discloses a bobeche which is constructed to prevent melted was from running down a lighted candle an onto a candlestick or candelabra. The bobeche is a slightly cupped annular collar which surrounds the lower end of a candle above a candle socket or a candlestick or candelabra to catch candle drippings and thus protect the candlestick or candelabra from melted wax. The bobeche includes a downwardly tapering neck embracing the lower portion of the candle and cooperating with the candle to provide an annular wax receiving pocket in which wax may solidify to prevent it from going below the bobeche. U.S Pat. No. 1,456,134 portrays an attachment for candlesticks and candleholders for catching candle drippings. The attachment consists of a cup-shaped stiffening element including a body portion having a central circular opening adapted to fit around a candle and rest upon a candlestick or candleholder. U.S. Pat. No. 722,318 comprises a drip cup for candlesticks. The device is constructed of two tubular member, the inner cylindrical tubular member or socket being adapted to receive a candle to support the shield.

DISCLOSURE OF INVENTION

The present invention is directed to a receptacle for collecting the wax drippings from a candle. As the candle burns, hot wax collects in a small well on the top of the candle. Continued burning results in the melted wax overflowing the well and dripping down the outer surface of the candle. If not contained, the dripping wax can flow onto and burn or otherwise damage the support surface, such as furniture, upon which the candle resides. Some candles are placed upon a candle holder or candlestick to afford some degree of protection to the support surface, however the drippings can still overflow the candle holder with the same undesirable result. In addition to potential damage, the dripping wax can present a formidable clean up task both of the support surface and the candle holder.

The present invention solves the aforementioned problems by providing a receptacle to collect the dripping wax. The receptacle is installed near the base of the candle and collects and contains the dripping wax so that the wax does not contact either the support surface or the candle holder. When the candle has burned down to a height of one or two inches, the entire package of burned candle, receptacle, and collected wax is simply discarded.

The present invention consists of an annular-shaped planar sheet which can be formed into a collar by overlapping the two sides of the sheet. The collar, in the form of a truncated cone, is then placed large end up, around the base of the candle thereby forming a receptacle or reservoir which collects the dripping wax. The collar can conveniently fit into a candle holder or candle stick. An adhesive deposited on at least one side of the sheet, holds the two sides together and retains the sheet in the collar shape. The present invention can accommodate a wide range of candle sizes because the extent of the overlap may be adjusted. Also, the present invention can be fabricated in a plurality of sizes and thereby fit virtually any size candle. Possible names for large and small embodiments of the present invention are "The Big Dripper" and "The Little Dripper" respectively.

In accordance with a preferred embodiment of the present invention, a receptacle for collecting wax drippings from a candle includes a sheet having a first side, an opposite second side, and an outer boundary. The sheet has a substantially circular hole which defines an inner boundary. An opening in the form of either a gap or a slit connects the outer boundary with he inner boundary, and defines a first end and a second end. A first adhesive is disposed on the first side of the sheet.

In accordance with another preferred embodiment, a second adhesive is disposed on the second side of the sheet.

In accordance with an important aspect of the invention, the sheet comprises a truncated conical surface.

In accordance with an important feature of the invention, the candle has a diameter d, and the circular hole has a diameter D which is greater than d.

In accordance with another important aspect of the invention, the substantially circular hole has a center, and the outer boundary is also substantially circular and has the same center.

In accordance with another important feature of the invention, the receptacle is fabricated from a nonflammable material.

In accordance with a preferred embodiment of the invention, the first and second sides of the sheet are overlapped to form a collar shaped like a truncated conical shell. The first adhesive adhesively engages the second side of the sheet, and the second adhesive adhesively engaging the first side of the sheet, thereby retaining the sheet in the shape of a collar.

In accordance with another preferred embodiment of the invention, a second adhesive is disposed on the second side of the sheet, and adhesively engages the first side of the sheet.

In accordance with an important aspect of the invention, the collar has a wall which forms a wall angle A with the candle, the wall angle A being substantially between 30° and 60°.

In accordance with an important feature of the invention, the circular hole has a diameter D which ranges substantially between 1.155 d and 2 d.

In accordance with another important aspect of the invention, a plurality of said receptacles are provided wherein the diameters D of successive receptacles have the relationship $D_{n+1} \leq 1.73\ D_n$, where $D_n$ is the diameter of the nth receptacle and $D_{n+1}$ is the diameter of the nth plus one receptacle.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
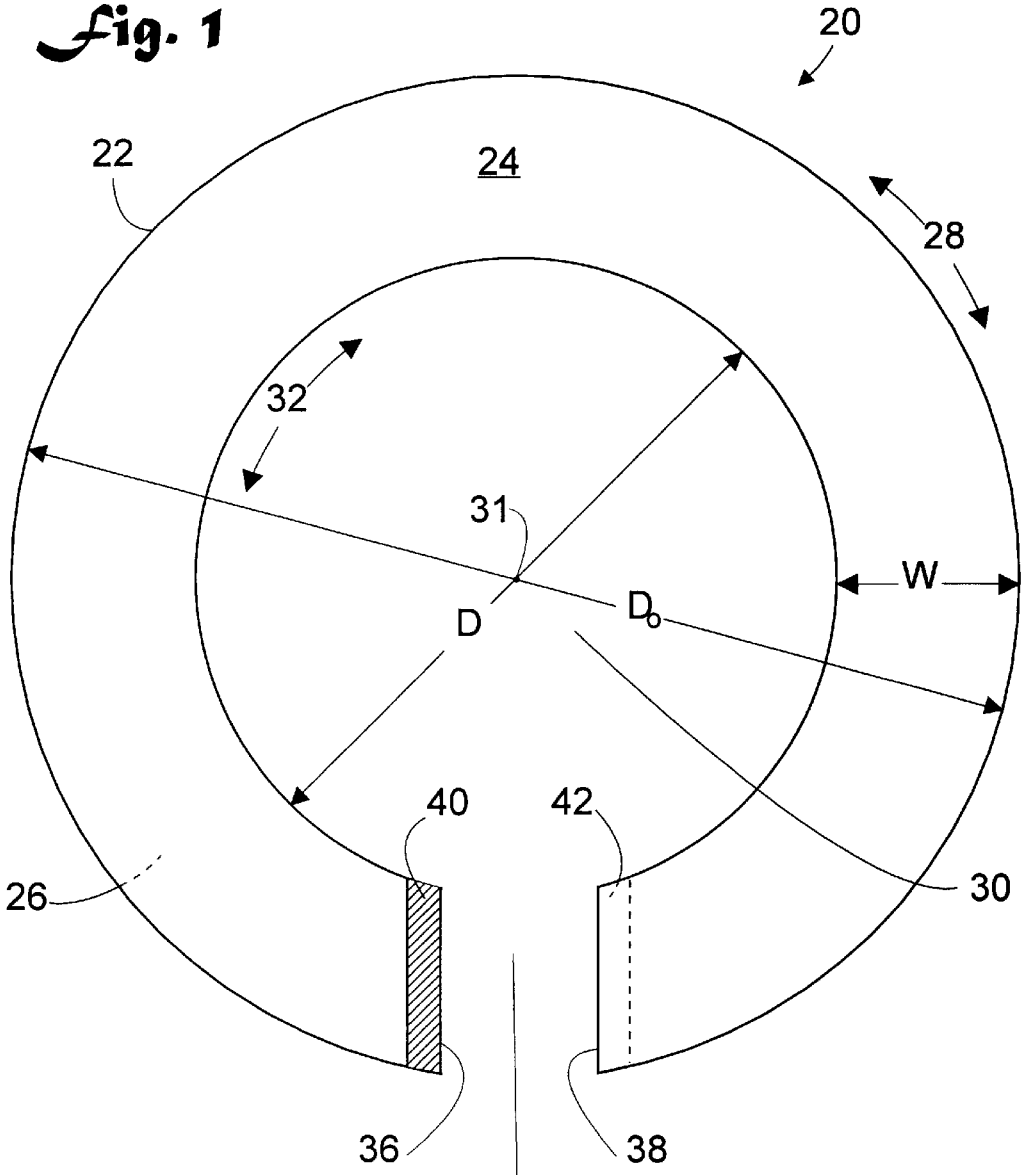
FIG. 1 is top plan view of a receptacle for collecting wax drippings from a candle, the receptacle shown in a flattened configuration.
Figure 2:
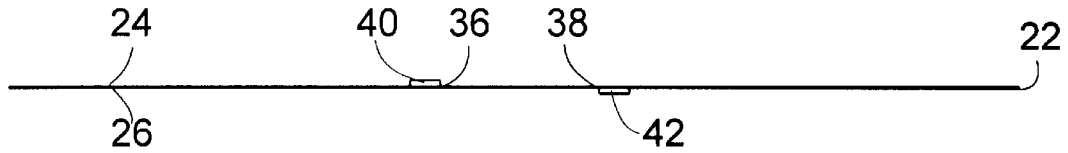
FIG. 2 is a side elevation view.

Referring initially to FIGS. 1 and 2, there are illustrated top plan and side elevation views respectively of a receptacle for collecting wax drippings from a candle in accordance with the present invention, generally designated as 20. In FIGS. 1 and 2, receptacle 20 is shown in a flattened configuration which comprises a sheet 22 having a first side 24, an opposite second side 26, and an outer boundary 28. Sheet 22 has a substantially circular hole 30 of diameter D which defines an inner boundary 32. Hole 30 has a center 31. W is the radial width between the outer boundary 28, which has a diameter $D_o$, and the inner boundary 32 which has a diameter D. Sheet 22 has an opening or gap 34 which connects outer boundary 28 with inner boundary 32. Opening 34 defines a first end 36 and a second end 38. A first adhesive 40 is disposed on the first side 24 of sheet 22 near first end 36, and a second adhesive 42 is disposed on second side 26 of sheet 22 near second end 38. Placing adhesives 40 and 42 near ends 36 and 38 respectively ensures that ends 36 and 38 will be adhesively anchored when sheet 22 is formed into a collar. Put another way, substantially annular sheet 22 has a first side 24, an opposite second side 26, an outer boundary 28, and an inner boundary 32. An opening 34 defines a first end 36 and a second end 38. A first adhesive 40 is disposed on first side 24 near first end 36, and a second adhesive 42 is disposed on second side 26 near second end 38.

Figure 3:
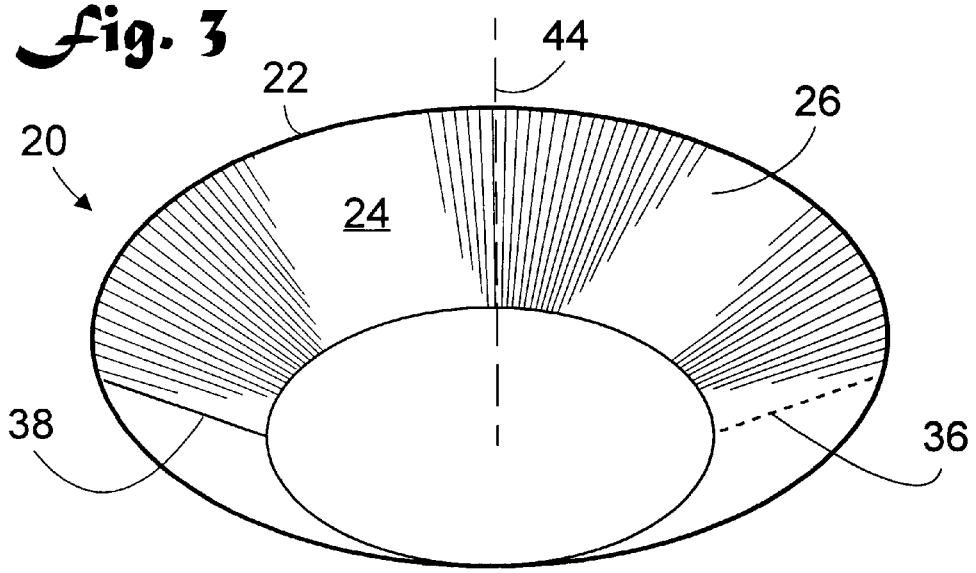
FIG. 3 is a perspective view of the sides of the receptacle overlapped to form a collar shaped like a truncated conical shell.

Sheet 22 comprises a truncated conical surface which may be formed in to a truncated conical shell-shaped collar as shown in FIG. 3. As used herein, the term truncated conical surface defines the surface of a truncated conical shell having a top and a base. A cut (or opening) in the form of a gap or slit is made between the top and the base of the truncated conical shell, resulting in a truncated conical surface which may be flattened. If both the top and the base are substantially perpendicular to the central axis of the truncated conical shell, the truncated conical shell is known as a frustoconical shell. In a preferred embodiment of the present invention, outer boundary 28 is substantially circular and has the same center 30 as inner boundary 32. Therefore, sheet 22 can be formed into a frustoconical shell (refer to FIG. 3). It is noted however, that since outer boundary 28 does not come into contact with the candle 500, outer boundary can be of virtually any shape. This is in contrast to inner boundary 32 which must be substantially circular in order to conform to the body of candle 500 which has a substantially circular cross section.

FIG. 3 is a perspective view wherein first side 24 and second side 26 of sheet 22 have been overlapped to form an upwardly opening collar having a central axis 44. First adhesive 40 (refer to FIG. 1) adhesively engages second side 26 of sheet 22, and second adhesive 42 (refer to FIG. 1) adhesively engages first side 24 of sheet 22, thereby retaining sheet 22 in the shape of a collar.

Figure 4:
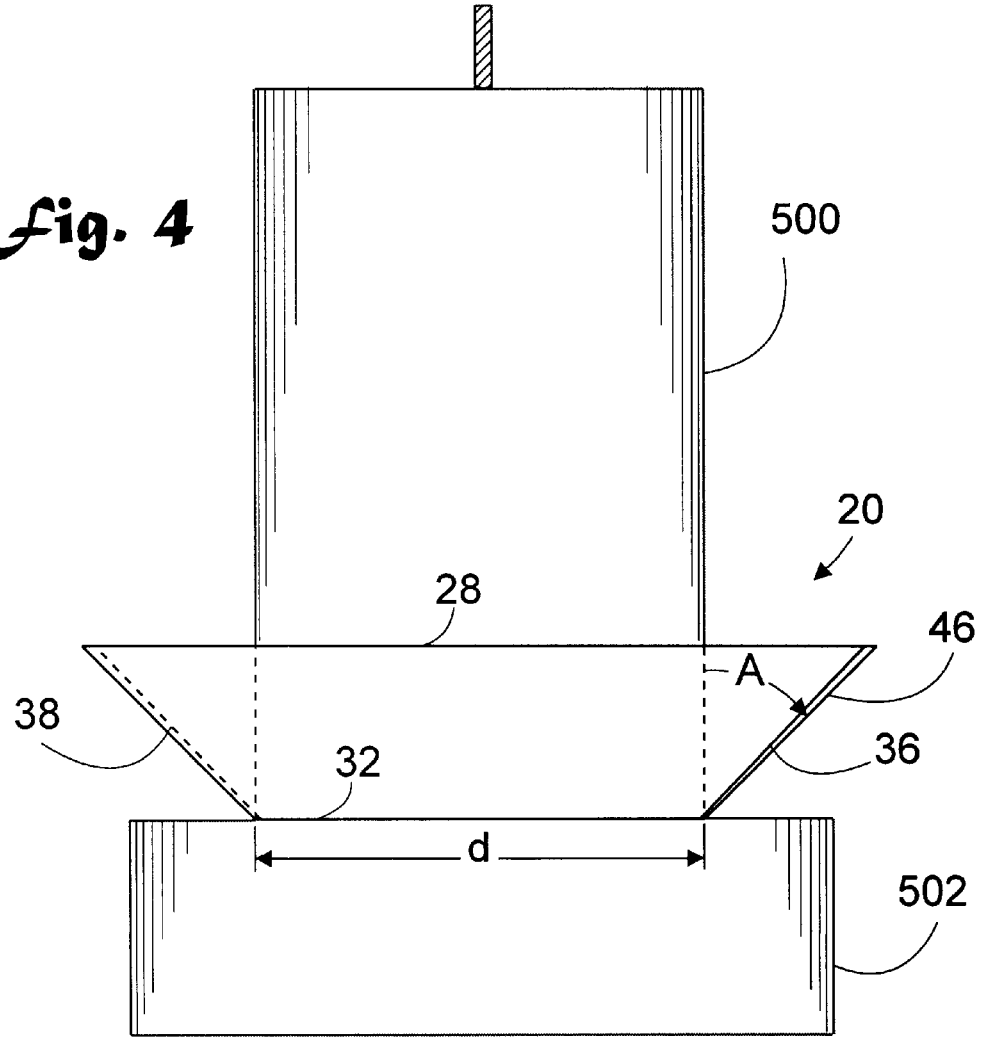
FIG. 4 is a side elevation view of the receptacle installed around a candle.

FIG. 4 is a side elevation view of receptacle 20, as shown in FIG. 3, installed around a candle 500 which has an elongated substantially circular body having a diameter d (as measured near the base). Candle 500 resides upon a base 502, such as a candle holder or candlestick. The collar defines a wall 46 which forms a wall angle A with the surface 503 of candle 500. It may be appreciated that the width W (refer to FIG. 8) of wall 46 may be selected to accommodate various size candles 500. For example, as the height or diameter of the candle 500 increases, a wider wall 46 is preferable in order to effectively contain the larger amount of dripping wax.

Figure 5:
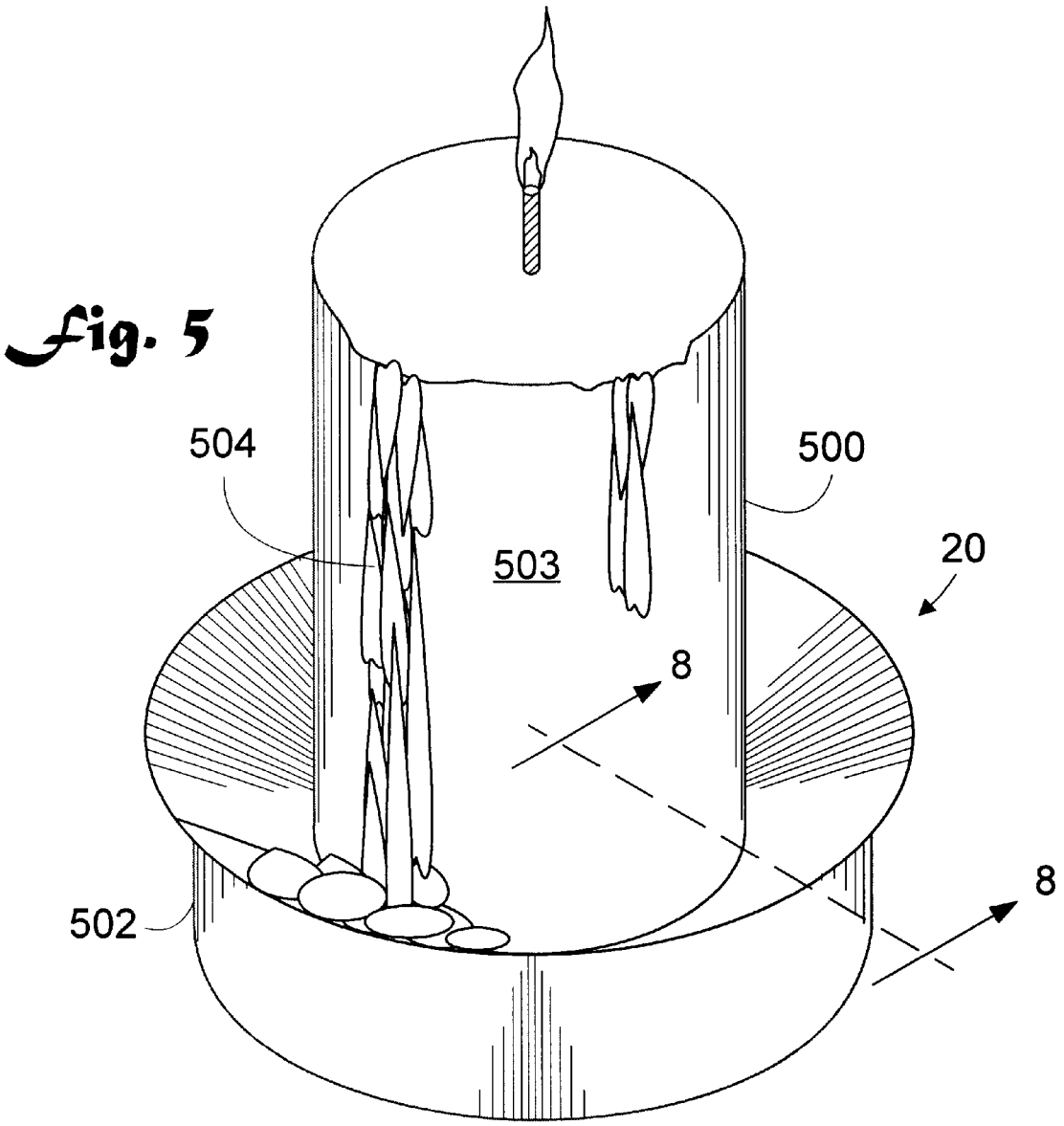
FIG. 5 is a perspective view of the receptacle installed around the candle.

FIG. 5 is a perspective view of receptacle 20 installed around candle 500. As candle 500 burns, wax 504 runs down outer surface 503 and is collected by receptacle 20.

Figure 6:
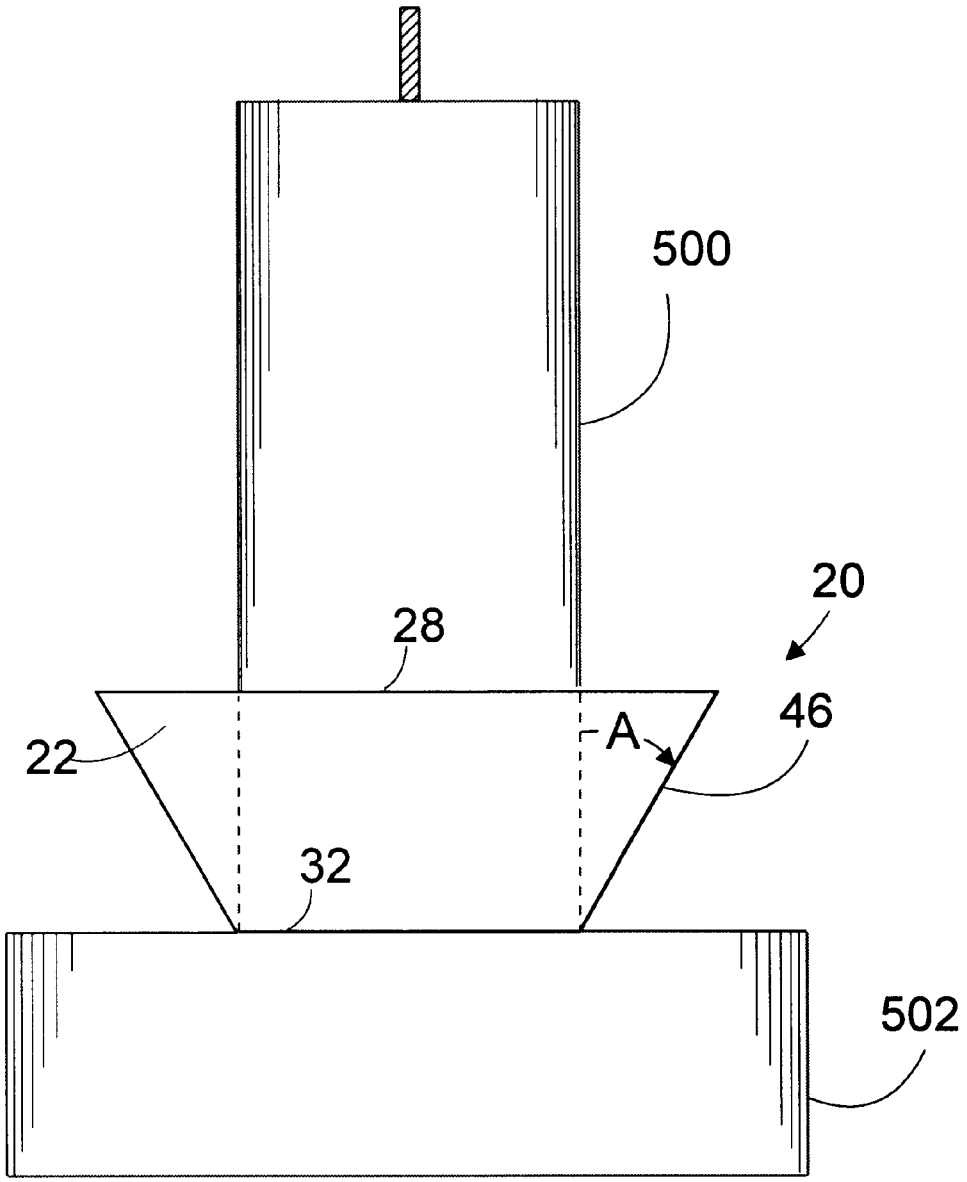
FIG. 6 is a side elevation view of the receptacle installed around a smaller diameter candle.

FIG. 6 is a side elevation view of receptacle 20 installed around a smaller diameter candle 500. In order for inner boundary 32 to closely abut the surface of candle 500, the sheet 22 must be overlapped more than in FIG. 4, resulting in a smaller wall angle A.

Figure 7:
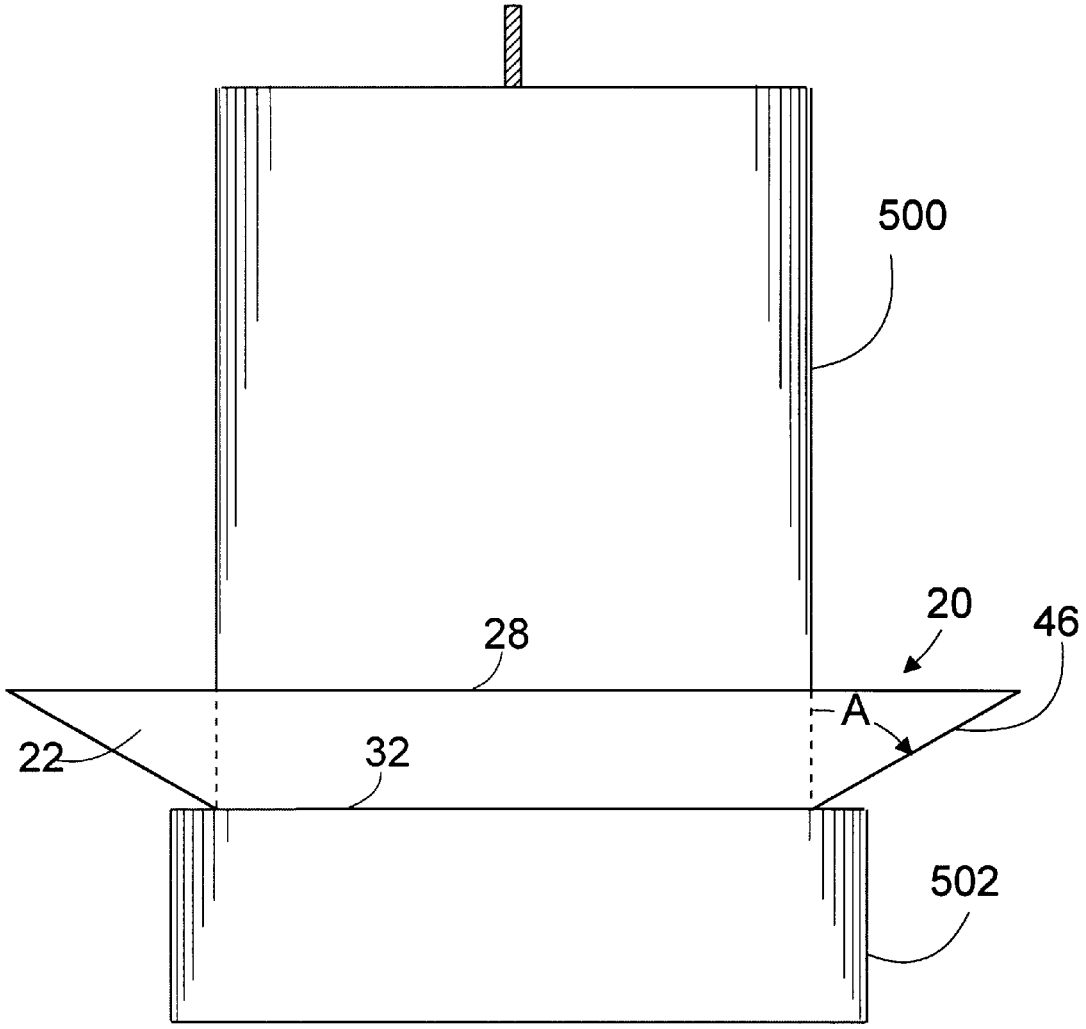
FIG. 7 is a side elevation view of the receptacle installed around a larger diameter candle.

FIG. 7 is a side elevation view of receptacle 20 installed around a larger diameter candle 500. In order to fit candle 500, the sheet 22 must be overlapped less than in FIG. 4, resulting in a larger wall angle A.

Figure 8:
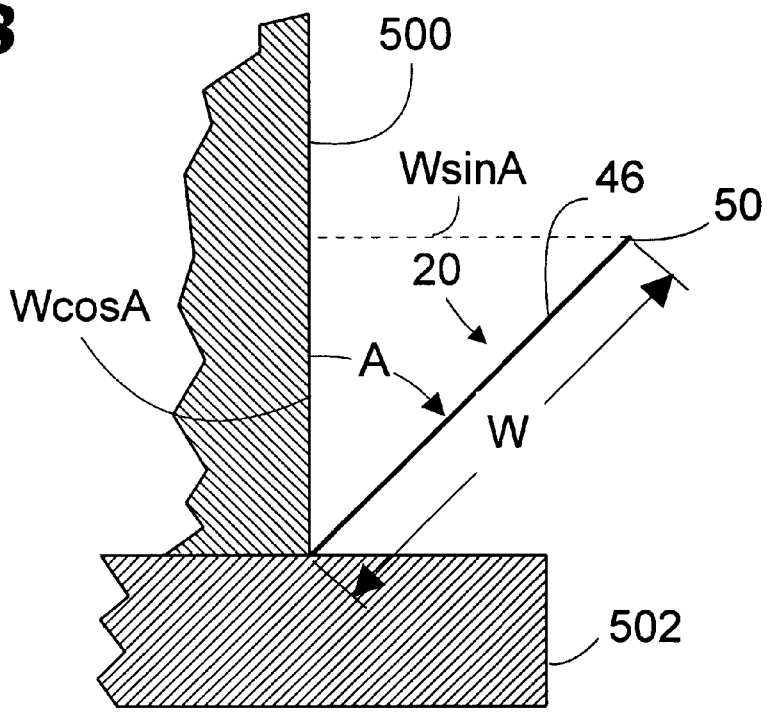
FIG. 8 is an enlarged cross sectional view along the line 8—8 of FIG. 5.

FIG. 8 is an enlarged cross sectional view along the line 8—8 of FIG. 5. Wall 46 of receptacle 20 forms a wall angle A with candle 500, the wall 46 having a width W (also refer to FIG. 1). The circumferential volume of the cavity 48 between wall 46 and candle 500 determines how much candle wax can be collected before the wax overflows over the outer lip 50 of wall 46. To minimize the possibility of wax dripping from candle 500 onto a table or other support structure, it is desirable to maximize the volume of cavity 48. Since wall 46 circumferentially extends all the way around candle 500, the volume of the cavity 48 will be maximized when the triangular area defined by (1) WcosA, (2) W, and (3) WsinA is maximized. The triangular area is defined by the equation:

$$\text{area}=(W \sin A \times W \cos A)/2$$

Figure 9:
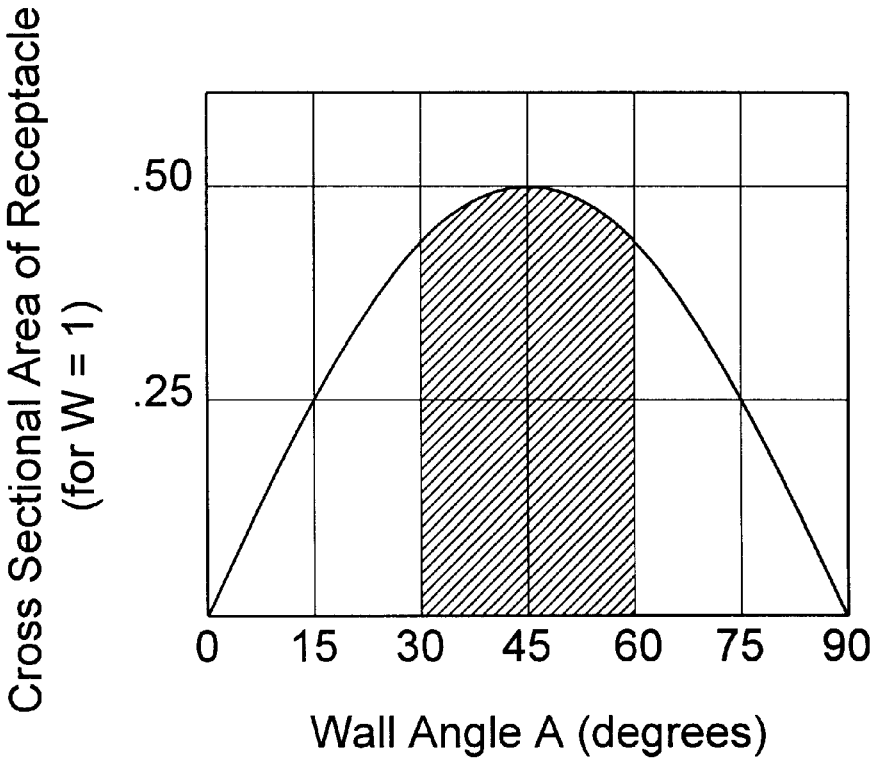
FIG. 9 is a plot of the cross sectional area of the receptacle as a function of wall angle A.

Referring now to FIG. 9, there is illustrated a plot of the triangular area of receptacle 20 as a function of wall angle A (for W=1). It is noted that the area is largest for A=45°, and diminishes rapidly for values of A less than 30° and greater than 60°. Therefore, in a preferred embodiment of the present invention, the dimensions of receptacle 20 are selected so that wall angle A is between 30° and 60°, 45° being the optimum.

Figure 10:
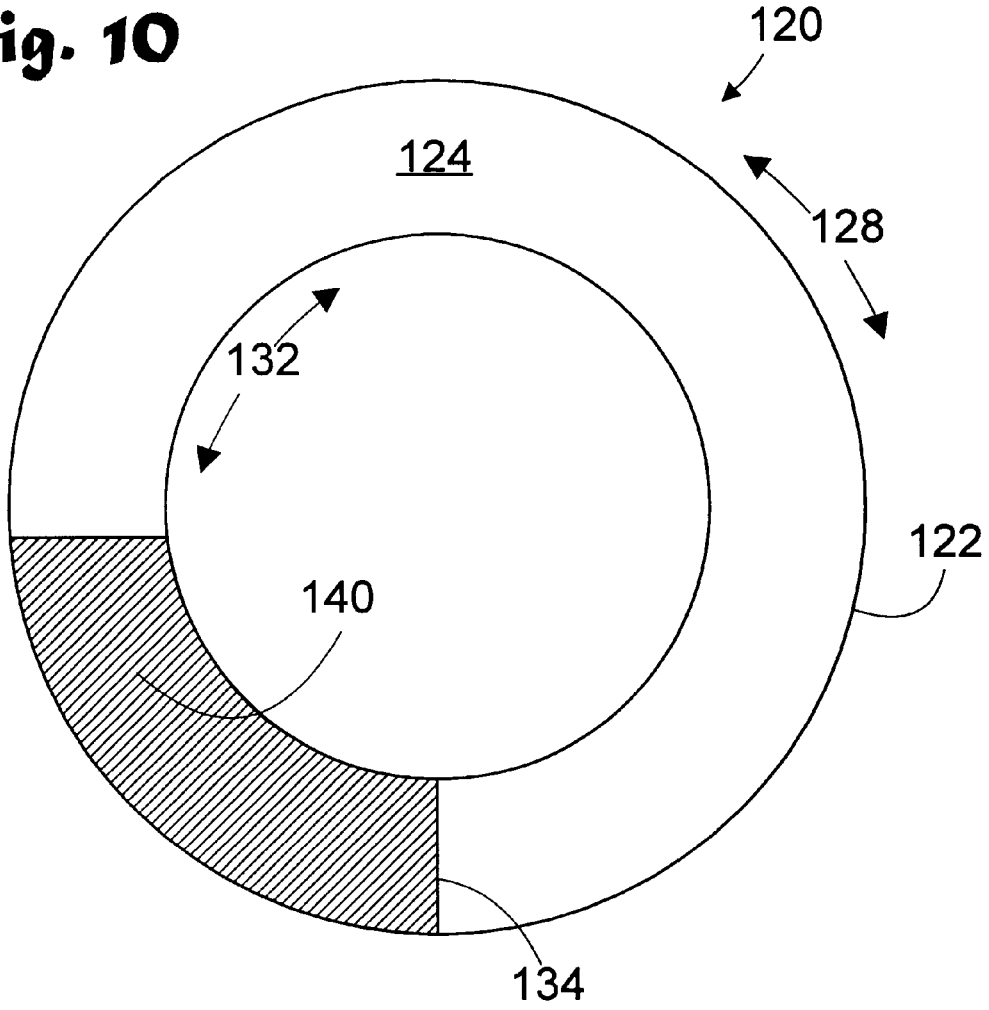
FIG. 10 is a top plan view of an alternative embodiment.
Figure 11:
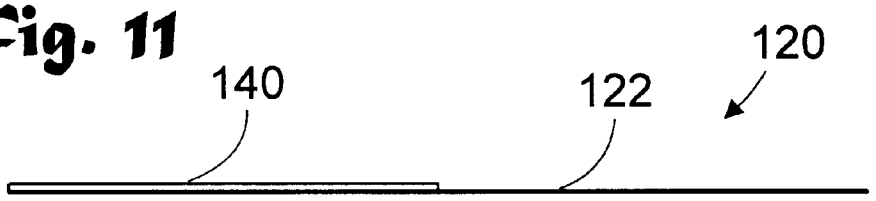
FIG. 11 is a side elevation view of the alternative embodiment.

FIGS. 10 and 11 are top plan and side elevation views of an alternative embodiment of the present invention, generally designated as 120. In this embodiment the opening which connects the inner 132 and outer 128 boundaries is a single slit 134. Also, adhesive 140 is only disposed on first side 124 of sheet 122. In a preferred embodiment, adhesive 140 is circumferentially disposed around a portion of first side 124 of sheet 122, however other adhesive 140 placements are also possible. It may be appreciated that the slit and/or the adhesive only on one side features of the present invention could be applied singularly or in combination.

It is noted that in order to (1) accommodate various diameter candles 500, and (2) achieve the desired wall angle A of between 30° and 60°, the size (circular diameter D) of the present invention must be selected accordingly. For example, a receptacle 20 having a small diameter D either could not fit around a larger candle 500, or could result in a wall angle A of greater than 60°. Also, a receptacle 20 having a large diameter D could be overlapped to fit a small candle 500, however the resulting wall angle A could be less than 30°. Therefore, a plurality of receptacle 20 sizes, or family of receptacles, are intended to be embraced by the principles disclosed herein.

Figure 12A:
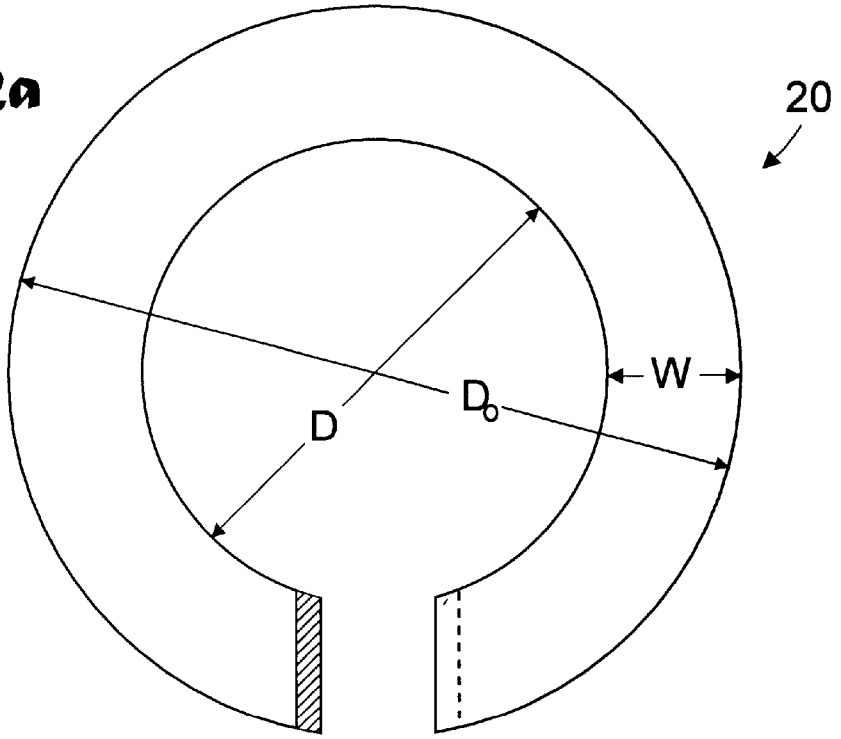
FIG. 12*a* is a top plan view of the receptacle.

Referring to FIGS. 12*a,* 12*b,* 12*c,* for a candle 500 of a given diameter d, it may be determined what circular hole diameter D is required to result in the preferred wall angle A of between 30° and 60°.

Referring to FIG. 12*a,* receptacle 20 is shown in its flattened configuration wherein;

$$Do=D+2W \quad (1)$$

Figure 12B:
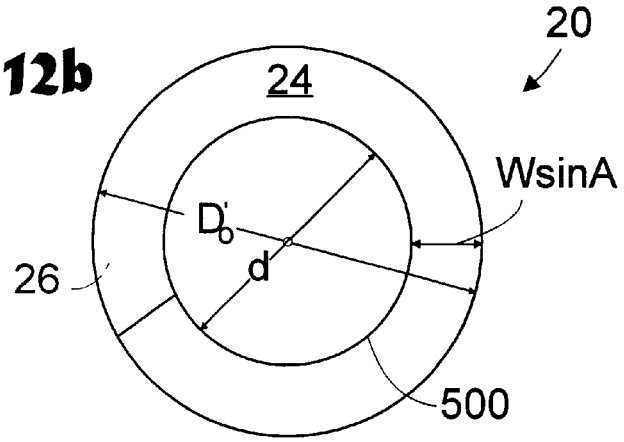
FIG. 12*b* is a top plan view of the receptacle after the two sides have been overlapped to fit around a candle.
Figure 12C:
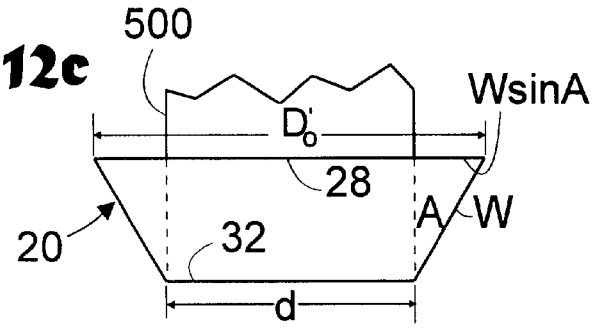
FIG. 12*c* is a side elevation view of FIG. 12*b;*.

Referring to FIGS. 12*b* and 12*c,* receptacle 20 has been overlapped to form a collar wherein inner boundary 32 fits snugly around diameter d of candle 500. The ratio of the inner and outer diameters is the same in the flattened and overlapped configurations, therefore;

$$D/Do=d/Do' \quad (2)$$

Now referring to FIG. 12*c,* it may be seen that;

$$Do'=d+2w\sin A \quad (3)$$

Plugging equations (1) and (3) into equation (2);

$$D=d/\sin A$$

Therefore for A=30°(sin*A*=0.5), D=2d, and for A=60° (sin*A*=0.866), D=1.155*d.*

Therefore, if diameter D is selected to be substantially between 1.155 and 2.0 times the diameter d of the candle 500, a wall angle A of between 60° and 30° respectively will be assured.

In view of the above, a plurality of different size receptacles 20 (i.e. a family of receptacles 20) may be provided so that at least one of the receptacles 20 is assured of having a wall angle in the desired 30° to 60° range for any size candle. Assume that the smallest candle 500 of interest has a diameter d=one-half inch, then a receptacle 20 having an inner diameter D=2d=one inch would result in a wall angle A no less than 30°. The one inch diameter D receptacle could also accommodate a candle 500 having a diameter of 0.866 inches with a wall angle of no greater than 60°. Therefore, if the next larger receptacle in the family is selected such that it has a 30° wall angle for a candle 500 having a diameter of 0.866 inches, a continuum of coverage is guaranteed. The necessary diameter Dnext of the next larger receptacle would have to be;

Dnext=(2/1.155)D, or about 1.73 inches.

The general relationship of diameters of successively larger receptacles 20 of the family is;

$D_{n+1}/2 \leqq D_n/1.155$, or $D_{n+1} \leqq 1.73\ D_n$, where $D_n$ is the inner diameter of the nth receptacle 20 and $D_{n+1}$ is the diameter of the next larger nth plus one receptacle 20. One possible family of receptacles 20 would have the following inner diameters D; 1.0, 1.73, 2.99, 5.18, 8.96, etc.

Figure 13:
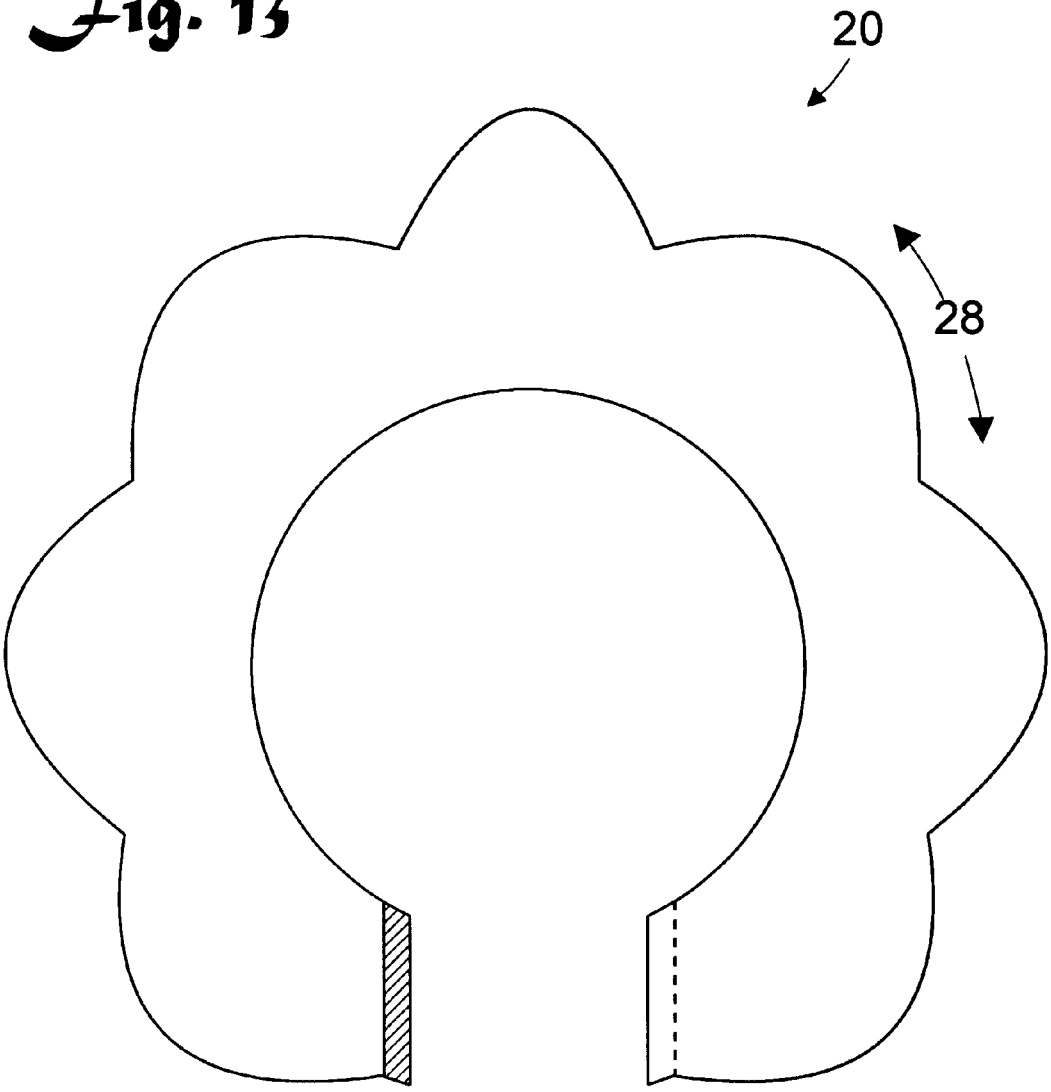
FIG. 13 is a top plan view of a receptacle wherein the outer boundary has decorative contours.

FIG. 13 is a top plan view of a receptacle 20 wherein the outer boundary has decorative contours.

Receptacle 20 is used by placing sheet 22 around the candle 500 and overlapping the first 24 and second 26 sides so as to form sheet 22 into a collar shaped like an inverted truncated conical shell. The amount of overlap is then adjusted until the inner boundary 32 snugly abuts the outer surface of the candle 500. Overlapping sides 24 and 26 are then pressed together so that first adhesive 40 adhesively engages second side 26 of sheet 22, and, if used, second adhesive 42 adhesively engages first side 24 of sheet 22, so that sheet 22 is retained in the collar shape. In a preferred embodiment a plurality of receptacles 20 are provided which have different diameter D circular holes 30. In order to ensure a wall angle A of between 30° and 60°, a receptacle 20 is selected such that diameter D is substantially between 1.155 and 2 times the diameter of candle 500.

In a preferred embodiment, sheet 22 is fabricated from a non-flammable paper, or other thin flexible non-flammable material. 24# to 80# SBS Cover Sheet has been found useful. Also, In a preferred embodiment, adhesive 40 and 42 comprises ST-580P double sided coated tape.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A receptacle for collecting wax drippings from a candle, comprising:

a sheet having a first side, an opposite second side, and an outer boundary;

said sheet having a substantially circular hole defining an inner boundary;

said sheet having an opening connecting said outer boundary with said inner boundary; and, a first adhesive disposed on said first side of said sheet.

2. A receptacle according to claim 1, further including:

a second adhesive disposed on said second side of said sheet.

3. A receptacle according to claim 1, said sheet comprising a truncated conical surface.

4. A receptacle according to claim 1, the candle having a diameter d, further including:

said circular hole having a diameter D which is greater than d.

5. A receptacle according to claim 1, further including:

said substantially circular hole having a center; and, said outer boundary being substantially circular and having said same center.

6. A receptacle according to claim 1, further including:

said first and second sides of said sheet overlapped to form a collar;

said first adhesive adhesively engaging said second side of said sheet; and, said sheet thereby retained in the shape of said collar.

7. A receptacle according to claim 6, further including:

said collar having a wall which forms a wall angle A with the candle.

8. A receptacle according to claim 7, further including:

said a wall angle A being substantially between 30° and 60°.

9. A receptacle according to claim 8, said wall angle A being substantially 45°.

10. A receptacle according to claim 1, further including:

the candle having a diameter d; and, said circular hole having a diameter D wherein D ranges substantially between 1.1 55 d and 2 d.

11. A receptacle according to claim 1, further including:

said circular hole having a diameter D; and, a plurality of said receptacles wherein said diameters D have the relationship $D_{n+1} \leqq 1.73D_n$ where $D_n$ is the diameter of the nth receptacle and $D_{n+1}$ is the diameter of the nth plus one receptacle.

12. A receptacle according to claim 1, further including:

said substantially circular hole having a center;

said outer boundary being substantially circular and having said same center;

said sheet fabricated from non-flammable paper;

said first and second sides of said sheet overlapped to form a collar;

said first adhesive adhesively engaging said second side of said sheet; and, said sheet thereby retained in the shape of said collar.

13. A method for collecting wax drippings from a candle, comprising the steps of:

providing a candle having a substantially circular outer surface of diameter d;

providing a receptacle comprising a sheet having a first side, an opposite second side, and an outer boundary, said sheet having a substantially circular hole of diameter D defining an inner boundary, said sheet having an opening connecting said outer boundary with said inner boundary, said opening defining a first end and a second end, a first adhesive disposed on said first side of said sheet;

placing said sheet around the candle;

overlapping said first and second sides of said sheet so as to form said sheet into a upwardly opening collar:

adjusting said overlap until said inner boundary snugly abuts the outer surface of the candle; and, pressing said overlapping sides together so that said first adhesive adhesively engages said second side of said sheet;

providing a plurality of said receptacles, said plurality including receptacles having circular holes of different diameters D;

selecting a said receptacle from said plurality such that D is substantially between 1.1 55 d and 2 d.

14. The method according to claim 13, further including the step of:

said plurality of said diameters D having the relationship $D_{n+1} \leqq 1.73D_n$, where $D_n$ is the diameter of the nth receptacle and $D_{n+1}$ is the diameter of the nth plus one receptacle.

15. A receptacle for collecting wax drippings from a candle, comprising:

an annular-shaped sheet having a first side, an opposite second side, an outer boundary, and an inner boundary;

said annular sheet having a slit defining a first end and a second end; and, a first adhesive disposed on said first side of said annular-shaped sheet.

16. A receptacle according to claim 15, further including:

a second adhesive disposed on said second side of said annular-shaped sheet.

* * * * *